United States Patent [19]

Remington

[11] 4,260,043

[45] Apr. 7, 1981

[54] VALANCE CLIP

[75] Inventor: Richard C. Remington, Pompton Plains, N.J.

[73] Assignee: Presto Lock Company, Division of Walter Kidde & Company, Inc., Garfield, N.J.

[21] Appl. No.: 66,873

[22] Filed: Aug. 15, 1979

[51] Int. Cl.[3] ..... A45C 13/04

[52] U.S. Cl. ..... 190/49; 24/73 B; 24/73 FT; 190/54

[58] Field of Search ..... 190/28, 49, 54; 52/826; 24/73 FT, 73 B

[56] References Cited

U.S. PATENT DOCUMENTS

| | | | |
|---|---|---|---|
| 2,685,473 | 8/1954 | Adell | 24/73 FT X |
| 2,758,682 | 8/1956 | Shwayder | 190/28 |
| 2,837,184 | 6/1958 | Fernberg | 24/73 FT X |
| 2,856,230 | 10/1958 | Adell | 24/73 FT X |
| 3,006,444 | 10/1961 | MacCallum | 24/73 FT X |
| 3,197,935 | 8/1965 | Clancy | 24/73 FT X |
| 3,207,275 | 9/1965 | Axtell | 190/54 |
| 3,251,438 | 5/1966 | Bedford | 190/54 |

*Primary Examiner*—Donald F. Norton
*Attorney, Agent, or Firm*—Shapiro and Shapiro

[57] ABSTRACT

A clip for securing a valance to a luggage shell encompasses the edge of the shell and includes means for biting into the shell to securely attach the clip to the shell, and a pair of members formed for abutting engagement with inner shoulders on both the inner and outer flanges of the valance to oppose forces tending to separate the valance from the shell.

10 Claims, 6 Drawing Figures

VALANCE CLIP

BACKGROUND OF THE INVENTION

This invention relates to improvements in clips for securing valances to the shells of luggage cases.

In manufacturing luggage cases from molded plastic material, two opposing concave shells, molded from a suitable plastic material as is well known, have attached thereto metal frames or valances which extend around their peripheral edges. The valances, which finish and protect the edges of the shells, are generally formed by extruding or casting a lightweight metal, such as aluminum or magnesium alloys. When extruded, the strips are cut to size and bent to fit around the peripheral edges of the shells. The edge of the shell fits within a channel formed between inner and outer flanges of the valance. The outer flange protects the edge of the shell. The inner flange provides a convenient surface for the attachment of hinges and other hardware.

A problem in the attachment of valances to shells is the tendency of the shell to slip out of the valance unless firmly attached. One common way of attaching the valance is with rivets extending through the shell and the inner flange. To provide the required anchorage, the inner flange must ordinarily be made wider, which creates a problem in bending the valances to fit around the shell since there is a tendency of the inner flange to buckle. Furthermore, corresponding rivet holes must be either positioned in the shell and the valance when they are fabricated or drilled during assembly. This complicates the manufacture and assembly of luggage cases, and requires that the valance be designed for particular shell configurations.

An alternative method of attaching valances to shells uses spaced clips which fit between the edge of the shell and the valance. As disclosed, for example, in Bedford, U.S. Pat. No. 3,251,438, May 17, 1966, a J-shaped clip fits over the edge of a shell. The short leg of the clip includes serrations for biting into the outer surface of the shell. The longer inner leg of the clip includes a downwardly depending lip which engages a slot or a groove in the inner leg of a valance to hold the valance on the shell. The valance is formed with the slots or grooves in the desired locations of the clips.

SUMMARY OF THE INVENTION

It is a principal object of the invention to provide a new and improved clip for attaching valances to luggage shells.

It is also an object to provide a clip which attaches a valance more securely to a shell.

It is a further object to provide a clip which does not require use of a valance having slots or grooves in predetermined locations.

It is a still further object to provide clips which simplify the assembly of valances to shells.

In accordance with one aspect, a clip adapted to encompass the edge of a luggage case shell and secure a valance thereto comprises means for gripping the shell to secure the clip to the shell, and means for engaging the inner and outer flanges of the valance and having means for abutting inner shoulders formed on the valance flanges.

In accordance with more specific aspects, a luggage case comprises a shell, a clip on the peripheral edge of the shell, and a valance having a channel between an inner and outer flange for receiving the edge of the shell and the clip, the clip including a base formed to extend along the edge of the shell, a first pair of members extending outwardly from the base, each having means for biting into the shell for securing the clip to the shell, and a second pair of members extending outwardly from the base, each formed for abutting engagement with an inner shoulder on each flange of the valance, to secure the valance to the shell.

These, and other objects, advantages, features and improved results afforded by the invention will become apparent from the following detailed description and drawings of preferred embodiments thereof.

DESCRIPTION OF THE PREFERRED EMBODIMENTS

Figure 1:
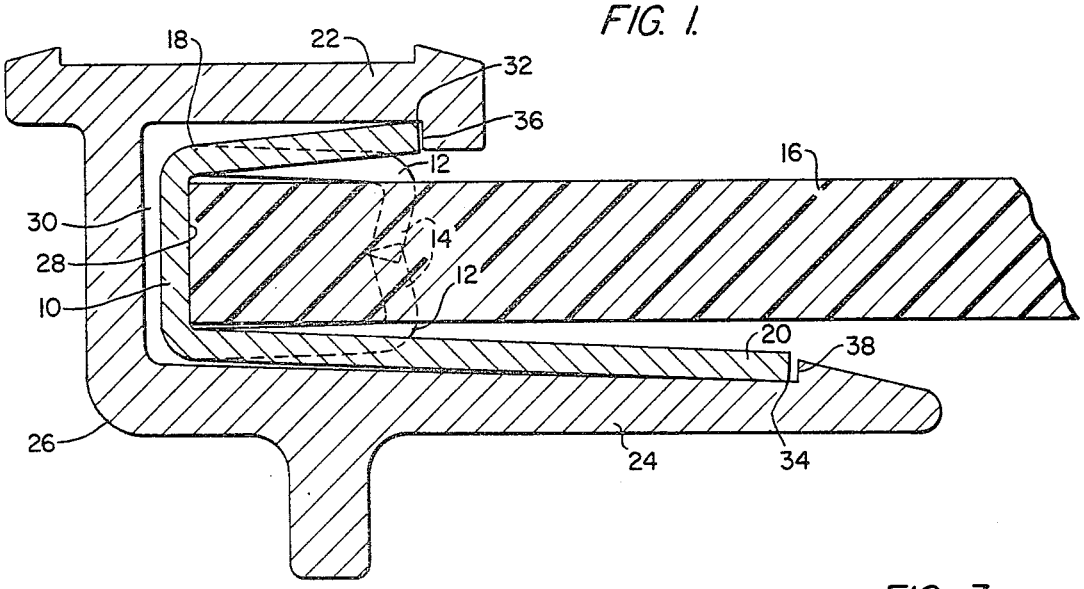
FIG. 1 is a cross sectional view showing a valance, a portion of a luggage case shell and the clip of the invention which secures the shell within the valance.
Figure 2:
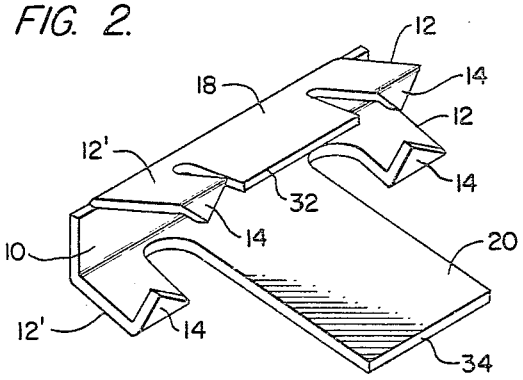
FIG. 2 is a perspective view of the clip.
Figure 3:
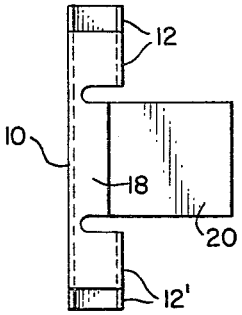
FIG. 3 is a top plan view of the clip.
Figure 4:
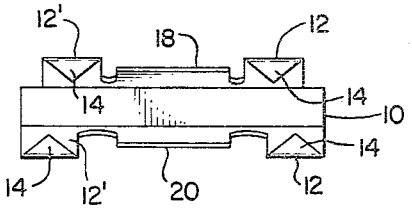
FIG. 4 is a side view of the clip.

Referring particularly to FIG. 1, the clip comprises a base 10, a first pair of flanges or members 12 extending outwardly from opposite sides of the base, each member having an inwardly turned end portion 14 for gripping the opposite sides of a luggage case shell 16 inserted between the members, and a second pair of flanges or members 18, 20, also extending outwardly from opposite sides of the base, the ends of which engage the outer and inner flanges 22, 24, respectively, of a valance 26. The base is formed to extend laterally to and be in abutting relationship with the edge 28 of the shell so that the clip encompasses the edge of the shell and fits within the channel 30 formed between the valance flanges.

Each inwardly turned end portion 14 is formed to bite into the side of the shell. Preferably, they are formed so that when they bite into the shell, they are angled slightly toward the base 10 to resist forces tending to separate the valance from the shell (to the left in FIG. 1). As is shown in FIG. 1, base 10 is sized to be slightly larger than the thickness of the shell 16 so that when the clip is in place, members 12 extend along the sides of the shell, generally parallel therewith. End portions 14 biting into the shell hold the base in abutting relationship with edge 28 of the shell and securely fasten the clip to the shell.

Members 18, 20 extend outwardly from base 10 at an obtuse angle. Preferably, the clip is formed of relatively thin steel having sufficient resilience so that when the clip is in the valance channel, members 18, 20 are compressed toward the sides of shell 16 and their ends 32, 34 press against the inner surfaces of the valance flanges. Adjacent to the ends 32, 34 of members 18, 20, the valance flanges are formed with inner shoulders 36, 38 for abutting engagement with ends 32, 34, respectively. Ends 32, 34 form an obstruction so that forces exerted on the valance tending to separate it from the shell cause the shoulders to come into abutting engagement with the ends. Since the clip is secured to the shell by members 12, shoulders 36, 38 abutting the obstruction formed by ends 32, 34 prevent the separation of the valance from the shell. Significantly, members 12 grip the shell on opposite sides thereof to securely attach the clip to the shell, and members 18, 20 are positioned to engage shoulders on both the outer and inner valance flanges, respectively, to secure the valance to the luggage shell.

As illustrated in FIG. 1, the dimensions of members 12, 18 and 20 are such that the clip fits entirely within the channel of the valance and is hidden from view. A series of clips spaced around the edge of a shell are sufficient to firmly attach a valance to the shell, without requiring rivets through the shell and the valance. Accordingly, the width of the inner valance flange 24 may be reduced, and there are no unsightly rivet heads through the shell. Furthermore, members 18, 20 are preferably straight and formed so that their end edges contact the valance flanges just inside the shoulders. This restricts the amount by which the valance can move to the slight spacing between the ends of members 18, 20 and the shoulders. The resilience of the clip maintains the ends of members 18, 20 in engagement with the inner surfaces of the flanges, and holds them in positions to ensure engagement with the shoulders.

FIGS. 2–5 illustrate a preferred embodiment of the clip. As shown, the clip preferably has two pairs 12, 12' of shell-gripping members spaced on either side of the valance-engaging members 18, 20. Each shell-gripping member has an inwardly turned prong 14 for biting into the shell. As clearly shown in FIG. 4, the opposing shell-gripping members of each pair are offset slightly from one another along the side of the clip, to permit the prongs to bite into the opposite sides of the shell without interfering with one another. Preferably, the prongs are dimensioned such that they extend approximately half way through the shell, as shown in FIG. 1. The two spaced pairs of shell-gripping members better resist forces in the plane of shell 16 (perpendicular to the plane of FIG. 1) which tend to pull the clip from the shell. Accordingly, the clip is more securely attached to the shell. Although the shell-gripping members are illustrated with a single prong, other arrangements may be employed, such as a plurality of serrations on each member which bite into the sides of the shell.

Figure 5:
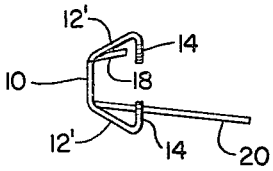
FIG. 5 is an end view of the clip.

As shown in FIG. 5, the clip is formed with the prongs 14 separated to permit the clip to be placed over the edge of a shell. Once in place, members 12, 12' can be pressed together as with pliers or other suitable tools to cause the prongs to bite into the shell. The clip must have sufficient ductility to permit members 12, 12' to be bent readily beyond their elastic limit so that the prongs 14 are retained in the shell.

Figure 6:
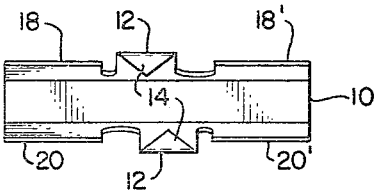
FIG. 6 is a side view similar to FIG. 4 illustrating an alternate embodiment of the clip.

FIG. 6 illustrates another embodiment of the clip. As shown, the clip may be formed with a single pair of shell-gripping members 12 having prongs 14, and two pairs 18, 20 and 18', 20' of valance-engaging members spaced on either side of members 12.

The clips may be conveniently stamped from sheet metal, such as cold rolled steel, as a single piece, and bent into the shape illustrated. It is an advantage that valance-engaging members 18, 20 are straight, since this eliminates a bending step in the fabrication of the clip and obviates the need for lip-mating grooves or slots in the valance corresponding to the desired locations of the clips. Moreover, forces exerted on the members 18, 20 by the shoulders abutting ends 32, 34 are directed along and lie in the planes of the members. The forces are, therefore, primarily compressive since the members are integral with the base which is held fixed by prongs 14 biting into the shell. Since the members are stronger in compression than in bending the clip can thus withstand larger forces exerted on it by the valance. The valance 26 may be cast or extruded as is well known. Shoulders 36, 38 are preferably continuous around the length of the valance and may be conveniently formed as part of the extrusion or casting process.

To attach a valance to a luggage shell, clips are spaced around the peripheral edge of the shell at convenient locations, and the shell-gripping members thereof pressed together to bite into the opposite sides of the shell. The valance may then be pressed into place over the clip so that members 18, 20 enter the channel formed between the valance flanges, and their end portions are positioned to abut the shoulders 36, 38. It is an advantage that the clips may be spaced at convenient locations around the shell, without the necessity for mating with slots or grooves at particular locations in the valance. This facilitates the manufacture and assembly of the luggage case.

Since rivets are not necessary to attach the valances to the shells, the inner valance flange 24 may, if desired, be made shorter than would otherwise be necessary, facilitating the bending of the valance to fit the shell. Furthermore, since no rivet heads are visible on the outer surfaces of the shell, the case has a more pleasing appearance.

While a preferred embodiment of the invention has been described, it will be apparent that various changes may be made without departing from the spirit and scope of the invention. For example, while it is preferred that the clip be provided with means for biting into opposite or both sides of the shell, the clip may be provided with means which extends into only one side of the shell to secure the clip to the shell.

I claim:

1. A clip adapted to encompass the edge of a luggage case shell and secure a valance thereto, the valance having inner and outer flanges each having an inner shoulder, the clip comprising a base, means for gripping the shell to secure the clip to the shell, the gripping means including a first pair of members extending from opposite sides of the base, each having an inwardly turned end portion with means for biting into the shell, and a second pair of straight members extending from the base for engaging the inner and outer flanges of the valance and having means for abutting the inner shoulders.

2. The clip of claim 1, wherein the base is formed for abutting relationship with the edge of the shell and sized so that when the biting means bite into the shell, the first members extend along the sides of the shell generally parallel thereto.

3. The clip of claim 1, wherein said means for gripping further comprises an additional pair of members extending from the base spaced from said first and second pairs of members, the additional pair of members having means for biting into the opposite sides of the shell.

4. The clip of claim 1, wherein the the ends of the second pair of members are formed for abutting engagement with the shoulders of the valance flanges.

5. A clip adapted to encompass the edge of a luggage case shell and secure a valance thereto, the valance having inner and outer flanges each having an inner shoulder, the clip comprising a base, a first pair of members extending from opposite sides of the base, each having an inwardly turned end portion with means for biting into the shell to secure the clip to the shell, and second and third pairs of members extending from the base and spaced on opposite sides of said first pair of members for engaging the inner and outer flanges of the valance and having means for abutting the inner shoulders.

6. The clip of claim 5, wherein the members of said second and third pairs of members are straight.

7. A luggage case comprising a shell, a clip on the peripheral edge of the shell, and a valance having a channel between an inner and outer flange for receiving the edge of the shell and the clip, each flange having an inner shoulder, the clip including a base, a first pair of members extending from the base and having means for gripping the shell to secure the clip to the shell, and a second pair of straight members extending from the base and formed for abutting engagement with said shoulders to secure the valance to the shell.

8. The luggage case of claim 7, wherein the means for gripping the shell includes means for biting into the shell.

9. The luggage case of claim 7, wherein the second pair of members extend outwardly from the base at an obtuse angle thereto.

10. The luggage case of claim 7, wherein the shoulders of the valance flanges are formed for abutting engagement with the ends of the second pair of members.

* * * * *